US009031435B2

(12) United States Patent
Sato

(10) Patent No.: US 9,031,435 B2
(45) Date of Patent: May 12, 2015

(54) IMAGE FORMATION APPARATUS

(71) Applicant: Oki Data Corporation, Tokyo (JP)

(72) Inventor: Junji Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/018,466

(22) Filed: Sep. 5, 2013

(65) Prior Publication Data

US 2014/0072319 A1 Mar. 13, 2014

(30) Foreign Application Priority Data

Sep. 11, 2012 (JP) ..... 2012-199541

(51) Int. Cl.
*G03G 15/01* (2006.01)
*G03G 15/00* (2006.01)

(52) U.S. Cl.
CPC ..... *G03G 15/0178* (2013.01); *G03G 15/0121* (2013.01); *G03G 15/0194* (2013.01); *G03G 15/502* (2013.01); *G03G 2215/0141* (2013.01)

(58) Field of Classification Search
CPC ..... G03G 15/0121; G03G 15/0178; G03G 15/502; G03G 15/0194; G03G 2215/0141
USPC ..... 399/54, 81
See application file for complete search history.

(56) References Cited

U.S. PATENT DOCUMENTS 5,014,095 A * 5/1991 Yamada ..... 399/226
2004/0037573 A1* 2/2004 Hirota et al. ..... 399/12
2008/0145071 A1* 6/2008 Ogasawara ..... 399/28

FOREIGN PATENT DOCUMENTS

JP 2005-049727 A 2/2005
JP 2006-259283 A 9/2006
JP 2007-033788 A 2/2007

OTHER PUBLICATIONS

JP 2005-049727, Arai et al., Feb. 24, 2005 English Translation.*

* cited by examiner

*Primary Examiner* — Ryan Walsh
(74) *Attorney, Agent, or Firm* — Marvin A. Motsenbocker; Mots Law, PLLC

(57) ABSTRACT

An image formation apparatus includes: a developer image formation section configured to form plural developer images whose colors are different from each other; a transfer device configured to transfer the plural developer images onto a medium while superimposing the developer images on each other, thereby to form a multi-color developer image on the medium; and a memory configured to store information on priority color settings including plural priority colors and transfer orders of the plural developer images which are predetermined for the respective priority colors. When one of the priority colors is selected, the image formation apparatus transfers the plural developer images sequentially in the transfer order for the priority color setting of the selected priority color.

18 Claims, 16 Drawing Sheets

Fig.7

| PRIORITY COLOR SETTING | TRANSFER ORDER UPSTREAM SIDE ⇔ DOWNSTREAM SIDE |
|---|---|
| STANDARD SETTING | C-M-Y-K |
| RED-PRIORITIZED SETTING | K-C-M-Y |
| BLUE-PRIORITIZED SETTING | K-Y-M-C |
| GREEN-PRIORITIZED SETTING | K-M-C-Y |

Fig.12

| PRIORITY COLOR SETTING | TRANSFER ORDER UPSTREAM⇔DOWNSTREAM SIDE SIDE | NUMBER OF TIMES OF RETURN CONVEYANCE REQUIRED DEPENDING ON PRECEDING ARRANGEMENT ORDERS OF DEVELOPMENT UNITS | | | |
|---|---|---|---|---|---|
| | | C-M-Y-K | K-C-M-Y | K-Y-M-C | K-M-C-Y |
| STANDARD SETTING | C-M-Y-K | 0 | 1 | 3 | 3 |
| RED-PRIORITIZED SETTING | K-C-M-Y | 1 | 0 | 3 | 3 |
| BLUE-PRIORITIZED SETTING | K-Y-M-C | 3 | 3 | 0 | 2 |
| GREEN-PRIORITIZED SETTING | K-M-C-Y | 3 | 3 | 2 | 0 |

IMAGE FORMATION APPARATUS

CROSS REFERENCE TO RELATED APPLICATIONS

This application claims priority based on 35 USC 119 from prior Japanese Patent Application No. 2012-199541 filed on Sep. 11, 2012, entitled "IMAGE FORMATION APPARATUS", the entire contents of which are incorporated herein by reference.

BACKGROUND OF THE INVENTION

1. Field of the Invention

This disclosure relates to an image formation apparatus. An electrophotographic tandem color printer includes development units independently provided for four color toners of black (K), cyan (C), magenta (M) and yellow (Y), and performs printing by superimposing toner images in the respective colors on a print sheet. The development units are individually and detachably loaded into the printer and are each replaceable when the development unit is depleted. Here, if a user loads the development units in the wrong arrangement order by mistake, color reproducibility of a printed image is lowered and the true colors cannot be obtained. Such a user mistake is prevented, for example, by providing specific notches or lockout pins to fitting portions where the respective development units are fitted to an apparatus body of the printer.

In this regard, an image formation apparatus is disclosed in Patent Document 1 (Japanese Patent Application Publication No. 2007-033788 (Paragraphs 0033 to 0042, FIGS. 4 and 5)) that stores optimum arrangement orders of development units which respectively correspond to modes (no designation/long life mode/high image quality mode) selectable by the user. The image formation apparatus detects the arrangement order of the actually loaded development units, and determines whether or not the detected arrangement order of the development units matches the arrangement order preset for the mode (no designation/long life mode/high image quality mode) selected by the user. If the detected order does not match the preset order, the image formation apparatus notifies the user of an arrangement abnormality and prompts the user to change the arrangement order of the development units (to rearrange the development units). If the user, even being aware of the notification, instructs the image formation apparatus to perform printing as it stands without changing the arrangement order of (i.e., without rearranging) the development units, then the image formation apparatus performs the printing in accordance with the current arrangement order while correcting various printing conditions on the basis of correction information stored in advance.

SUMMARY OF THE INVENTION

However, the related art may have difficulty in obtaining a high image quality. An object of an embodiment of the invention is to improve the image quality.

An aspect of the invention is an image formation apparatus that includes: a developer image formation section configured to form plural developer images whose colors are different from each other; a transfer device configured to transfer the plural developer images onto a medium while superimposing the developer images on each other, thereby to form a multicolor developer image on the medium; and a memory configured to store information on priority color settings including plural priority colors and transfer orders of the plural developer images which are predetermined for the respective priority colors. When one of the priority colors is selected, the image formation apparatus transfers the plural developer images sequentially in the transfer order for the priority color setting of the selected priority color.

Thus, this aspect of the invention improves image quality.

BRIEF DESCRIPTION OF THE DRAWINGS

FIG. 7 is an explanatory view illustrating examples of selectable priority colors and transfer orders of toners corresponding to selection of the priority colors of the first embodiment.

FIG. 12 is an explanatory view illustrating examples of transfer orders and the number of times of return conveyance corresponding to priority color settings of the second embodiment.

DETAILED DESCRIPTION OF EMBODIMENTS

Figure 1:
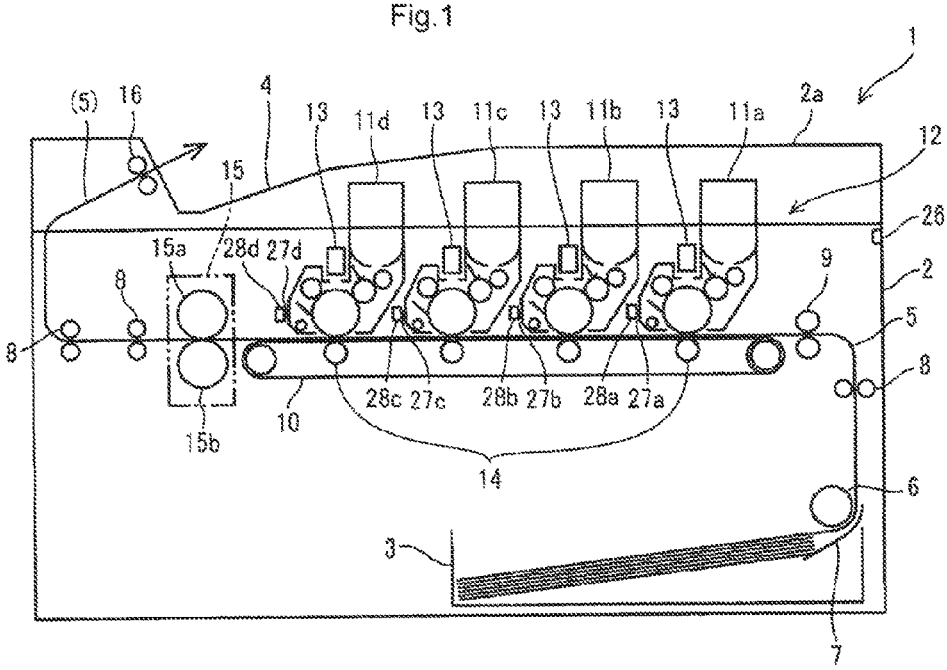
FIG. 1 is an explanatory view illustrating a printer of a first embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Embodiments of an image formation apparatus of the invention are described below with reference to the drawings.

First Embodiment

A printer of a first embodiment is described below with reference to FIG. 1 to FIG. 10. In FIG. 1, reference numeral 1 denotes a printer serving as an image formation apparatus. Printer 1 of this embodiment is a tandem-type electrophotographic color printer. Cover 2*a* is provided on an upper part of apparatus body 2 of printer 1 and is connected in an openable and closable manner. Paper feed cassette 3 is disposed in a lower part of apparatus body 2 and contains print sheets as printing media. Stacker 4 is provided on an upper face of cover 2*a* for stacking printed paper sheets. Paper feed cassette 3 is connected to stacker 4 through paper conveyance passage 5.

In addition, paper feed roller 6 and separator 7 are configured to pinch and feed paper sheets one by one from paper feed cassette 3 to paper conveyance passage 5 and are provided at a junction between paper conveyance passage 5 and paper feed cassette 3. Conveyance rollers 8 and registration rollers 9 are disposed on a downstream side of paper feed roller 6 in a direction of conveyance of the paper sheets (hereinafter referred to as a paper conveyance direction). Conveyance rollers 8 are configured to sandwich and convey each paper sheet fed from paper feed cassette 3. Registration rollers 9 are configured to convey the paper sheet conveyed from conveyance rollers 8 while correcting a skew of the paper sheet.

On a downstream side of registration rollers 9 in the paper conveyance direction, there is disposed conveyance belt 10 stretched between two rollers and configured to convey the paper sheet conveyed by registration rollers 9. Developer image formation section 12, that can form plural developer images (toner images) in different colors, is disposed on an upper face portion of the parallel face portions of conveyance belt 10. Developer image formation section 12 includes development units 11*a*, 11*b*, 11*c*, and 11*d* (which may be simply indicated with an 11 as appropriate). Each of development units 11*a*, 11*b*, 11*c*, and 11*d* serves as a single color developer image formation unit configured to form a single color developer image (the single color toner image). Development units 11 (11*a*, 11*b*, 11*c*, and 11*d*) are arranged along conveyance belt 10. Exposure head 13 serves as an exposure device to form an electrostatic latent image and is disposed opposite to each development unit 11. Meanwhile, transfer roller 14 serving as a transfer device to transfer the toner image (the developer image) formed by each development unit 11 to the paper sheet is disposed opposite each development unit 11 across conveyor belt 10. Here, the plural developer images formed respectively by plural development units 11 are transferred to the paper sheet in such a manner as to be superimposed on one another. As a consequence, a multi-color developer image is formed on the paper sheet. On a downstream side of conveyance belt 10 in the paper conveyance direction, there is disposed fixation device 15 configured to subject the multi-color toner image transferred to the paper sheet to a fixation onto the paper sheet by pressing and heating with heat roller 15*a* and backup roller 15*b*.

Heat roller 15*a* of fixation device 15 incorporates a not-illustrated heating member (a heater), and is pressed against backup roller 15*b* with an appropriate pressure by a not-illustrated pressing member (a spring). In addition, on the downstream side of fixation device 15 in the paper conveyance direction, there are disposed conveyance rollers 8 configured to sandwich and convey the paper sheet discharged from fixation device 15, and discharge rollers 16 configured to discharge the printed paper sheet onto stacker 4.

Developer image formation section 12 of printer 1 of this embodiment includes four independent development units 11 (11*a*, 11*b*, 11*c*, and 11*d*). Development units 11 contain toners (developers) in predetermined original colors (i.e., black (K), yellow (Y), magenta (M), and cyan (C)), respectively, and are arranged in the paper conveyance direction. Development units 11 are attachable to and detachable from apparatus body 2. The loading positions of development units 11 can be changed by a user. Since all four development units 11 have the same structure, one of development units 11 is hereinbelow described.

Figure 2:
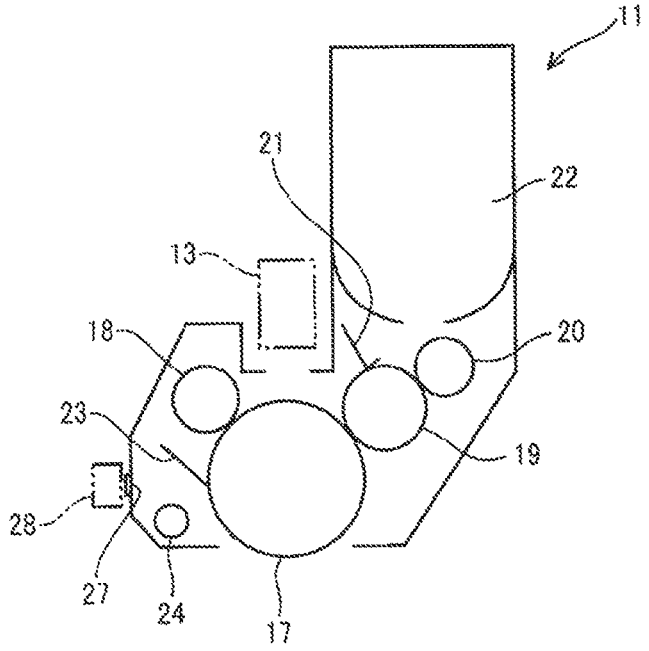
FIG. 2 is an explanatory view illustrating a development unit of the first embodiment.

As illustrated in FIG. 2, development unit 11 of this embodiment includes: photoconductor drum 17 serving as an image carrier on which an electrostatic latent image is formed by exposure head 13; charge roller 18 serving as a charger configured to homogeneously charge photoconductor drum 17; development roller 19 serving as a developer carrier configured to develop the electrostatic latent image on photoconductor drum 17 by attaching the toner thereto; supply roller 20 serving as a developer supplier configured to supply the toner to development roller 19; development blade 21 serving as a developer layer control member configured to reduce a thickness of a layer of the toner supplied from supply roller 20 to development roller 19 and to form a toner thin layer as a developer layer; toner tank 22 serving as a developer container containing the toner in the predetermined color; cleaning blade 23 serving as a cleaning member configured to scrape off and remove the toner remaining on photoconductor drum 17 after the toner image is transferred from photoconductor drum 17; waste toner conveyance screw 24 configured to convey the waste toner scraped off with cleaning blade 23 to a not-illustrated waste toner collection tank; and the like. Here, a combination of development roller 19, supply roller 20, development blade 21, and toner tank 22 functions as a developer supply device configured to supply the toner to photoconductor drum 17.

In the meantime, development units 11 are each integrally constructed and made attachable to and detachable from printer 1. Accordingly, cover 2*a* of printer 1 is made openable and closable, and open/close detection sensor 26 is configured to detect an open or closed state of cover 2*a* and is provided on its release side. Moreover, each development unit 11 of this embodiment is provided with management tag 27, which is formed from an IC chip that stores color information as identification information on the toner contained in toner tank 22. Identification information readers 28*a*, 28*b*, 28*c*, and 28*d* serve as identification information reading parts configured to read the color information (toner identification information) stored in management tags 27*a*, 27*b*, 27*c*, and 27*d* in a contact or noncontact manner, and are provided at loading parts of apparatus body 2 for development units 11*a*, 11*b*, 11*c*, and 11*d*.

Figure 3:
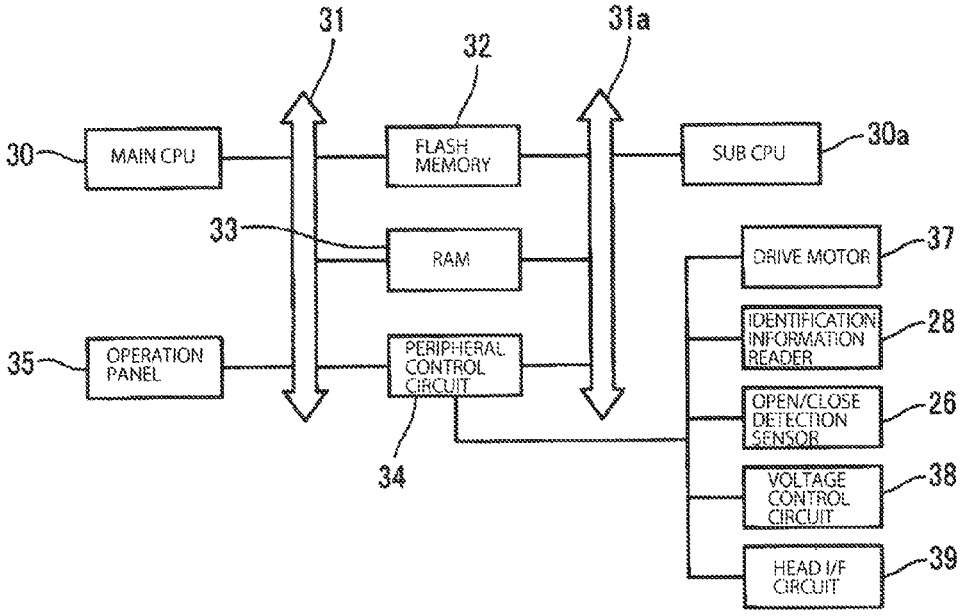
FIG. 3 is a block diagram illustrating a hardware configuration of the printer of the first embodiment.

In FIG. 3, reference numeral 30 denotes main CPU which is connected through main CPU bus 31 to flash memory 32, RAM 33, peripheral control circuit 34, and operation panel 35 serving as an operation part that enables input operations by the user. The functions of main CPU 30 include: management and control of the entire apparatus; an interface with operation panel 35; data transmission and reception to and from host system 36 (see FIG. 4) such as a personal computer; rendering of print data; and so forth.

Peripheral control circuit 34 is connected to: drive motors 37 configured to drive conveyance rollers 8, registration rollers 9, and the like; identification information readers 28; open/close detection sensor 26; a not-illustrated sensor configured to acquire intra-apparatus information; voltage control circuit 38 configured to control voltages to be supplied to charge rollers 18, transfer rollers 14, and the like; head I/F circuit 39 configured to drive exposure heads 13; and so forth. Sub CPU 30*a* is connected to flash memory 32, RAM 33, and peripheral control circuit 34 through sub CPU bus 31*a*. Note that main CPU 30 and sub CPU 30*a* are not directly connected to each other and information transmission therebetween is made through a command interface incorporated in peripheral control circuit 34.

Figure 4:
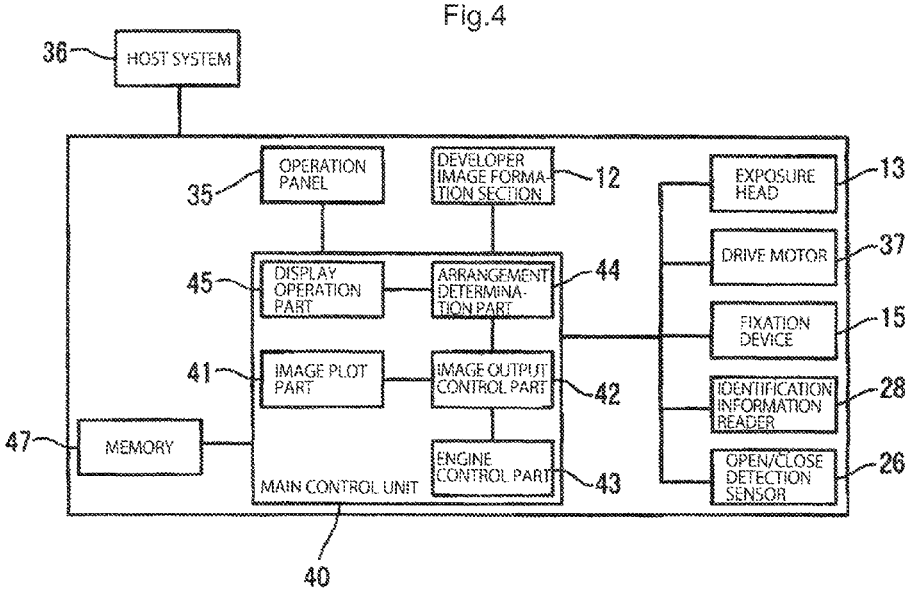
FIG. 4 is a block diagram illustrating the printer of the first embodiment.

In FIG. 4, reference numeral 40 denotes the main control unit serving as a print controller for printer 1. Main control unit 40 includes main CPU 30, sub CPU 30*a*, and the like and has functions to control the components in printer 1 and to execute a printing process and the like. Main control unit 40 is provided with image rendering part 41, image output control part 42, engine control part 43, arrangement determination part 44, display operation part 45, and the like. Reference numeral 47 denotes a memory serving as a storage device of printer 1, which includes: flash memory 32 that retains programs to be executed by main control unit 40 as well as nonvolatile data; RAM 33 that retains volatile data; and the like. Various data used for processes executed by main control unit 40, results of the processes by main control unit 40, and the like are stored in memory 47.

Image rendering part 41 has a function to render print data transmitted from host system 36 into bitmap images and to thereafter separate the bitmap images into image data in four colors of black (K), cyan (C), magenta (M), and yellow (Y). A function of image output control part 42 is to receive the image data in the respective four colors decomposed and generated by image rendering part 41 and to execute a print operation in conjunction with engine control part 43. Image output control part 42 also has the functions to distribute the image data to four exposure heads 13 in accordance with an arrangement order determined to match by arrangement determination part 44, and to perform electrical adjustment and control of development units 11.

Engine control part 43 has a function to respectively control drives of paper feed roller 6, conveyance rollers 8, conveyance belt 10, discharge rollers 16, fixation device 15, development units 11, and the like. Almost all of the control is executed through transmission and reception of signals by sub CPU 30*a* to and from peripheral control circuit 34. A function of arrangement determination part 44 is to read the color information (the toner identification information) stored in management tags 27*a* to 27*d* of development units 11 loaded on the respective loading parts by using identification information readers 28*a* to 28*d*. Arrangement determination part 44 also has the function to determine whether or not the current arrangement order of development units 11 matches a transfer order which is preset corresponding to a priority color setting selected by the user from plural priority color settings that are selectable by the user.

Figure 5:
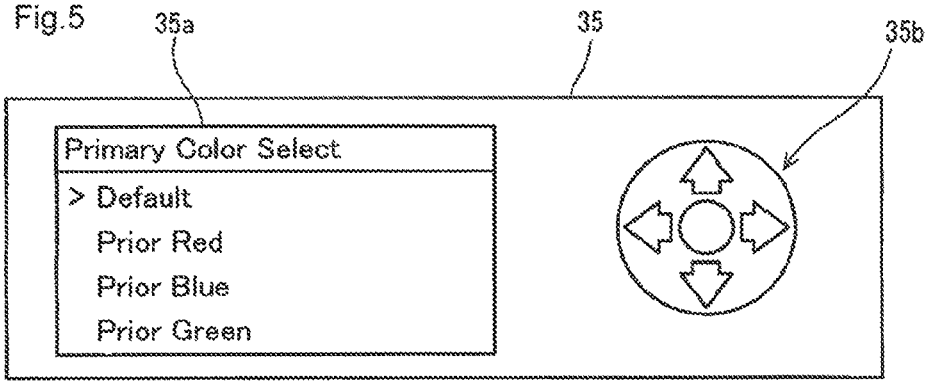
FIG. 5 is an explanatory view illustrating an operation panel of the first embodiment.

Display operation part 45 is connected to operation panel 35 as illustrated in FIG. 5, and includes: display screen 35*a* such as an LCD; cursor buttons 35*b* used for selecting upper, lower, right, and left directions; a not-illustrated print cancellation button; and the like. Display operation part 45 has a function to accept selection of a priority color setting of a priority color representing a color region for which the user intends to enhance representational accuracy among color regions that printer 1 can output. Display operation part 45 also has a function to display on display screen 35*a* a screen to prompt a procedure by the user, a screen to notify the user of certain information; and the like. This embodiment provides four settings as type settings (referred to as the priority color settings) of color reproducibility that the user intends to prioritize, namely, a standard setting (Default), a red-prioritized setting (Prior Red), a blue-prioritized setting (Prior Blue), and a green-prioritized setting (Prior Green).

Figure 6:
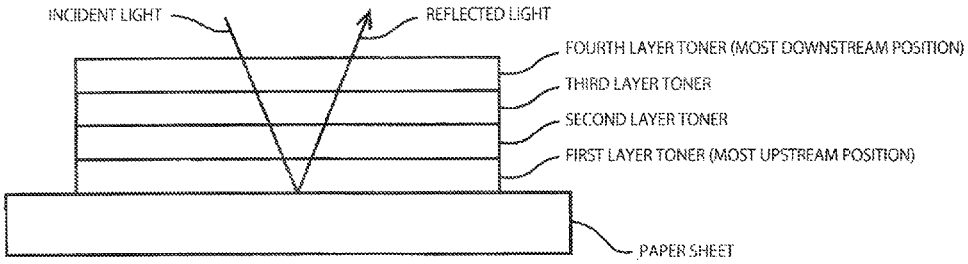
FIG. 6 is an explanatory view illustrating a state of laminating toner layers of the first embodiment.

A reason for providing the foregoing priority color settings is as follows. As illustrated in FIG. 6, in the structure of printer 1 of this embodiment, the toner in development unit 11*a* located most upstream in the paper conveyance direction is transferred as a first layer to a surface of a conveyed paper sheet. Then, the toner in development unit 11*b* located downstream thereof is transferred to the paper sheet as a second layer, and the toner in development unit 11*c* located further downstream thereof is transferred to the paper sheet as a third layer. Lastly, the toner in development unit 11*d* located most downstream is superimposed thereon as a fourth layer. In other words, in the state where the toners in the four colors are superimposed, the fourth layer constitutes the topmost layer. In this case, the toner transferred as the first layer is lost little by little due to reverse transfer every time the toner passes through second, third, and fourth development units 11 located on the downstream side. Similarly, the thicknesses of the toner layers from the second and third development units 11 are affected by the number of development units 11 that the toner layers pass through thereafter.

Specifically, electrophotographic printer 1 provided with development units 11 causes a phenomenon called a reverse transfer, in which part of the toner of the toner image transferred from development unit 11 on the upstream side in the paper conveyance direction to the paper sheet is transferred to photoconductor drum 17 of development unit 11 located on the downstream side. Accordingly, in terms of the individual colors, the toner transferred from development unit 11 located on the downstream side has a lower rate of loss by the reverse transfer so that this toner can achieve a higher color density than the toner transferred from development unit 11 located upstream thereof. As a consequence, reproducibility of the prioritized color is improved by locating the toner for producing the color to be prioritized as close to the downstream side in the paper conveyance direction as possible in the arrangement order of development units 11.

For example, when rates of the toners lost (referred to as toner reduction rates) by the reverse transfer occurring at second, third, and fourth development units 11 are denoted by a1, a2, and a3, respectively, a rate of fixation (referred to as a toner fixation rate) f1 of the toner transferred by first development unit 11 is expresses by:

$$f1=(1-a1)\times(1-a2)\times(1-a3) \quad (1).$$

Meanwhile, a toner fixation rate f2 of the toner transferred by second development unit 11 is expressed by:

$$f2=(1-a2)\times(1-a3) \quad (2).$$

Moreover, a toner fixation rate f3 of the toner transferred by third development unit 11 is expressed by:

$$f3=(1-a3) \quad (3).$$

The technique of the above-described PTL1 (Japanese Patent Application Publication No. 2007-033788) can make the toner reduction rates a1, a2, and a3 as small as possible by use of correction information, but this technique has a difficulty in improving color reproducibility of a printed image, or improving the reproducibility of a particular color region that the user expects to improve. In this regard, this embodiment responds to the expectation by the user by defining the four priority color settings described above. In this embodiment, as indicated in FIG. 7, transfer orders are predetermined for the respective priority colors and are stored in advance in memory 47 as respective priority color settings. In addition, image formation conditions for the respective priority color settings are stored in advance in memory 47. Examples of the image formation conditions include voltages to be applied to the components (such as charge rollers 18) in development units 11, voltages to be applied to transfer rollers 14 that face development units 11, and the like.

In the standard setting as a black-prioritized setting, development units 11 are arranged in the order of C-M-Y-K from the upstream side to the downstream side in the paper conveyance direction so as to transfer the original color toners in the order of C-M-Y-K. In this arrangement order, the toner in the color K for producing black as the prioritized color is transferred in the end. Thus, the amount of toner to be lost by the reverse transfer becomes less for the color K than for the other colors whereby the density of the black color can be relatively increased. As a consequence, this arrangement order can achieve a vivid print image for use in office documents which are mainly composed of characters in black.

In the red-prioritized setting, development units 11 are arranged in the order of K-C-M-Y from the upstream side to the downstream side in the paper conveyance direction. In this arrangement order, the toner in the color Y and the toner in the color M for producing red as the prioritized color are transferred later than the toners in the other colors (the toner in the color C and the toner in the color K). Thus, the amounts of the toners in the colors Y and M to be lost by the reverse transfer become less and the density of the red color can be relatively increased. As a consequence, this arrangement order can achieve a vivid print image with improved red-color reproducibility.

In the blue-prioritized setting, development units 11 are arranged in the order of K-Y-M-C from the upstream side to the downstream side in the paper conveyance direction. In this arrangement order, the color C and the color M for producing blue as the prioritized color are located on a top layer side. This arrangement order can achieve a vivid print image with improved blue-color reproducibility for the same reason as in the case of the red-prioritized setting. In the green-prioritized setting, development units 11 are arranged in the order of K-M-C-Y from the upstream side to the downstream side in the paper conveyance direction. In this transfer order, the color Y and the color C for producing green as the prioritized color are located on the top layer side. This transfer order can achieve a vivid print image with improved green-color reproducibility for the same reason as in the case of the red-prioritized setting.

As described above, in the priority color settings of this embodiment, when one original color toner is used for producing the priority color, the transfer order is determined in such a manner that development unit 11 configured to form the toner image in the corresponding color is located on the most downstream side (at the position of development unit 11*d* in FIG. 1) in the paper conveyance direction. Meanwhile, when two original color toners are used for producing the priority color, the transfer order is determined in such a manner that development units 11 configured to form the two toner images in the corresponding colors are located on the most downstream side (at the positions of development units 11*d* and 11*c* in FIG. 1) in the paper conveyance direction. Here, when two or more original color toners are used for producing the priority color, a decision as to which one of the original color toners is to be used for the topmost layer is made depending on the degrees of densities of the toner colorants in the respective original color toners.

Figure 8:
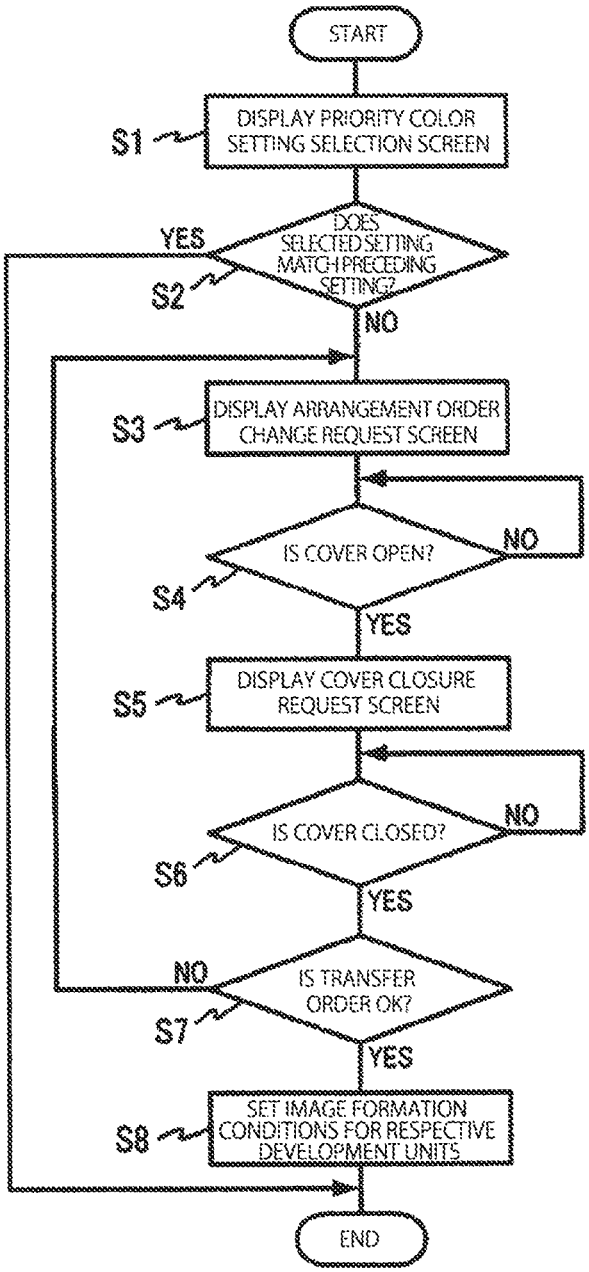
FIG. 8 is a flowchart illustrating a priority color setting process of the first embodiment.

A priority color setting process of this embodiment is described below in accordance with steps indicated with S by using the flowchart illustrated in FIG. 8. The user who conducts printing by using printer 1 of this embodiment performs the priority color setting with printer 1 before transmission of the print data from host system 36. In the meantime, a priority color setting executed in an immediately preceding printing process (referred to as a preceding priority color setting), and the transfer order as well as the image formation conditions in the priority color setting are saved in memory 47 of printer 1.

Figure 9A:
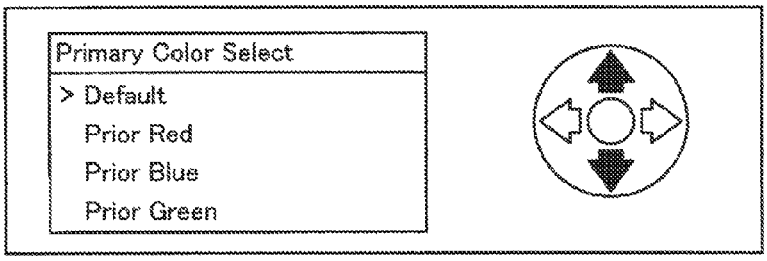
FIGS. 9A to 9E are explanatory views illustrating screen display examples in the priority color setting process of the first embodiment.
Figure 9B:
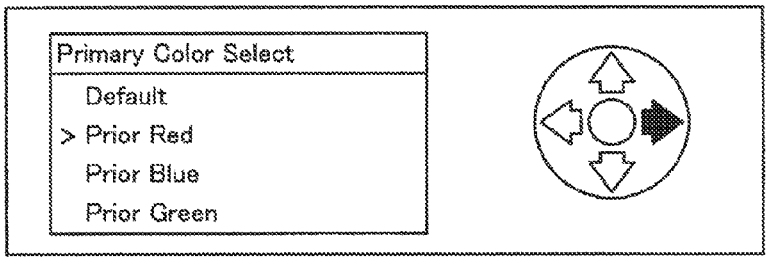

S1: Main control unit 40 of printer 1 is standing by with display operation part 45 displaying a priority color setting selection screen as illustrated in FIG. 9A, which displays four priority color settings selectable by the user, on display screen 35*a* of operation panel 35. Main control unit 40 proceeds to step S2 when one of the priority color settings is selected. Main control unit 40 continues to stand by if none of the priority color settings is selected. Here, an operation to select the priority color setting by the user is performed as follows. Specifically, the user who selects the priority color setting selects one of the standard setting, the red-prioritized setting, the blue-prioritized setting, and the green-prioritized setting on the priority color setting selection screen while pressing an up button and a down button among cursor buttons 35*b*, and then presses a right button as illustrated in FIG. 9B.

When the right button is pressed, main control unit 40 accepts a result of the selection through display operation part 45 and recognizes the selected priority color setting. The following descriptions are provided citing a case where the user selects the red-prioritized setting.

Figure 9C:
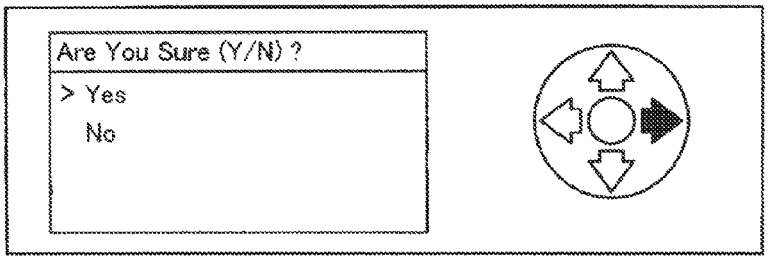

S2: Upon recognition of the selected priority color setting, main control unit 40 reads the preceding priority color setting saved in memory 47. When the read preceding priority color setting does not match the newly selected priority color setting, main control unit 40 displays a priority color setting confirmation screen as illustrated in FIG. 9C on display screen 35*a* of operation panel 35. Main control unit 40 proceeds to step S3 when the user selects "Yes." Main control unit 90 terminates the ongoing priority color setting process when the read preceding priority color setting matches the new priority color setting or when the user selects "No" on the priority color setting confirmation screen.

Figure 9D:
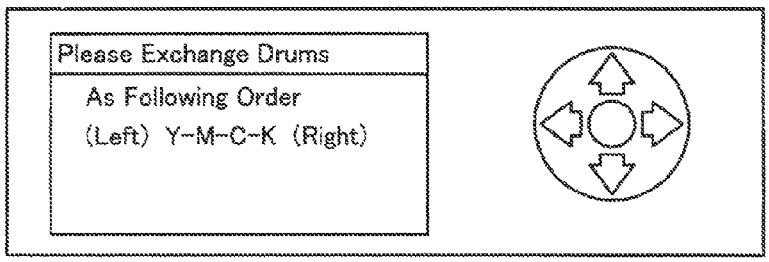

S3: When recognizing that the user changes the priority color setting to the new priority color setting which does not match the preceding priority color setting, main control unit 90 reads the transfer order and the image formation conditions for the selected priority color setting (which is the red-prioritized setting in this description) from memory 47, and displays an arrangement order change request screen as illustrated in FIG. 9D by using display operation part 45. Here, the arrangement order change request screen displays a statement to prompt a change in the arrangement order of development units 11, and the arrangement order (the arrangement order for the red-prioritized setting in this description) of development units 11 reflecting the prompted change. Thus, main control unit 40 informs the user of the arrangement order of development units 11 reflecting the prompted change and then proceeds to step S4.

S4: While displaying the arrangement order change request screen, main control unit 40 monitors an output signal from open/close detection sensor 26. When an opening signal indicating the opening of cover 2*a* is outputted from open/close detection sensor 26, main control unit 40 recognizes the opening of cover 2*a* and then proceeds to step S5. Main control unit 40 continues the monitoring unless the opening signal is outputted from open/close detection sensor 26.

Figure 9E:
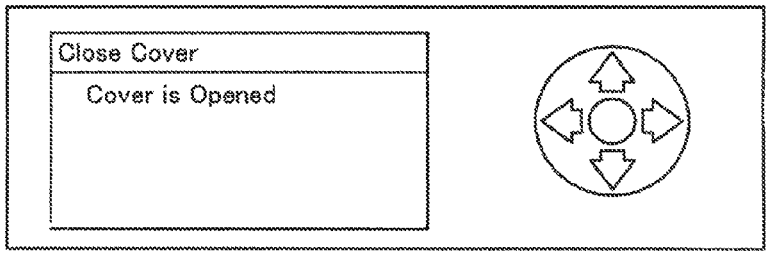
Figure 10:
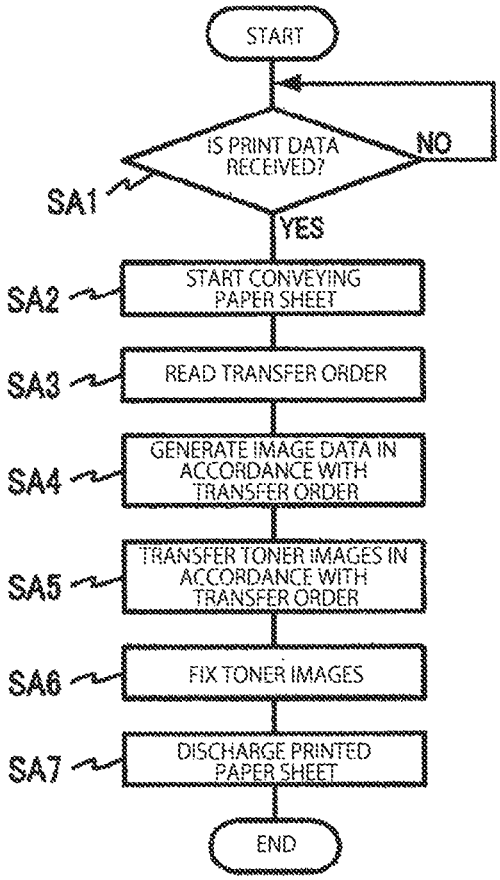
FIG. 10 is a flowchart illustrating a printing process of the first embodiment.

S5: Upon recognition of the opening of cover 2*a*, main control unit 40 displays a cover closure request screen on display screen 35*a* of operation panel 35 by using display operation part 45 as illustrated in FIG. 9E. The cover closure request screen displays a statement to inform the user of the opening of cover 2*a* and a statement to prompt the user to close cover 2*a*. Then, main control unit 40 proceeds to step S6.

S6: While displaying the cover closure request screen, main control unit 40 stands by, waiting for the output of a closure signal indicating the closure of cover 2*a*, which is outputted from open/close detection sensor 26 when the user changes the arrangement of development units 11 in accordance with the arrangement order displayed on arrangement order change request screen and then closes cover 2*a*. When the closure signal is outputted from open/close detection sensor 26, main control unit 40 recognizes the closure of cover 2*a* and then proceeds to step S7. Main control unit 40 continues to stand by while the closure signal is not outputted from open/close detection sensor 26.

S7: Upon recognition of the closure of cover 2*a*, main control unit 40 causes arrangement determination part 44 to read the color information (the toner identification information) stored in management tags 27*a* to 27*d* of development units 11*a* to 11*d* loaded on the respective loading parts by using identification information readers 28*a* to 28*d*. As a result of the reading, if the arrangement order of development units 11*a* to 11*d* matches the transfer order for the priority color setting selected by the user (the transfer order of the red-prioritized setting in this description), main control unit 40 recognizes that development units 11 are arranged in the transfer order for the selected priority color setting and then proceeds to step S8. As a result of the reading, if the arrangement order of development units 11*a* to 11*d* does not match the transfer order for the selected priority color setting, main control unit 40 returns to step S3 to display the arrangement order change request screen again on operation panel 35, and then repeats the processing operations from steps S4 to S7.

S8: After recognizing the arrangement of development units 11 in the transfer order for the selected priority color setting, main control unit 40 overwrites and saves in memory 47 the newly selected priority color setting, as well as the transfer order and the image formation conditions for the new priority color setting, which are read in step S3 described above. Then, main control unit 40 terminates the ongoing priority color setting process. Thus, the priority color setting process of this embodiment is executed. Descriptions will be hereinbelow provided for processing operations of a printing process by printer 1, to be carried out when the user, having completed the priority color setting, transmits the print data from host system 36 to printer 1 and conducts printing by using the priority color setting of this embodiment, in accordance with steps indicated with SA by using a flowchart illustrated in FIG. 10.

SA1: Main control unit 40 of printer 1 stands by waiting for reception of the print data to be transmitted from host system 36. Main control unit 40 proceeds to step SA2 upon receipt of the print data. Main control unit 40 continues to stand by while no print data is received.

SA2: Upon reception of the print data, main control unit 40 starts conveyance of the paper sheets contained in paper feed cassette 3. Specifically, main control unit 40 separately feeds the paper sheets one by one from paper feed cassette 3 to paper conveyance passage 5 by using paper feed roller 6 and separator 7, and conveys the paper sheets to conveyance belt 10 by using conveyance rollers 8 and registration rollers 9.

SA3: In parallel with the start of conveyance of the paper sheets, main control unit 40 reads the transfer order of the preceding priority color setting (the transfer order of the red-prioritized setting in this description) and the image formation conditions therefor which are saved in memory 47. Then, main control unit proceeds to step SA4.

SA4: After reading the transfer order and the like, main control unit 40 renders the received print data into the bitmap images by using image rendering part 41, then separates the bitmap images into the image data in the four colors of black (K), cyan (C), magenta (M), and yellow (Y), and sends the decomposed image data to image output control part 42. Image output control part 42 distributes the received image data, which are decomposed into the four colors, as the image data for four exposure heads 13 in accordance with the read transfer order, thereby generating the image data for the respective colors.

SA5: After generating the image data, main control unit 40 transfers the toner images to the paper sheet in the transfer order of the priority color setting on the basis of the transfer order and the image formation conditions thus read. Specifically, main control unit 40 causes image output control part 42 and engine control part 43 to homogeneously charge the surfaces of photoconductor drums 17 by using charge rollers 18 of development units 11 for the respective colors. Then, main control unit 40 irradiates the surfaces of the charged photoconductor drums 17 with light from exposure heads 13 respectively located opposite photoconductor drums 17 while switching the light on and off in accordance with the presence and absence of dots of the image data in the corresponding colors. Thus, main control unit 40 dissipates the charges at portions of the surfaces of the photoconductor drums 17 irradiated with the light, and thereby forms the electrostatic latent images thereon.

Concurrently, supply rollers 20 supply the toners supplied from toner tanks 22 onto the surfaces of corresponding development rollers 19. Development rollers 19 form the toner images by causing the toners, which are formed into the thin layers by development blades 21, to adhere to the electrostatic latent images formed on the surfaces of photoconductor drums 17. Thereafter, main control unit 40 applies transfer voltages to respective transfer rollers 14 based on the read image formation conditions, and thereby transfers the toner images formed on the surfaces of respective photoconductor drums 17 to a surface of the paper sheet conveyed by conveyance belt 10. Here, the toner images in respective development units 11 are transferred to the surface of the paper sheet in the arrangement order of development units 11, whereby a multi-color toner image is formed on the surface of the paper sheet by superimposing the toner images in the four colors. The toners remaining on the surfaces of photoconductor drums 17 without being transferred to the surface of the paper sheet are scraped off as waste toners by cleaning blades 23, and are collected into the not-illustrated waste toner collection tanks by waste toner conveyance screws 24.

SA6: After transferring the multi-color toner image formed from the toner images in the four colors to the surface of the paper sheet, main control unit 40 causes engine control part 43 to convey the paper sheet to fixation device 15. The multi-color toner image is fixed to the surface of the paper sheet by applying heat and pressure from fixation device 15.

SA7: After fixing the toner image to the paper sheet, main control unit 40 causes engine control part 43 to convey the printed paper sheet with the fixed toner image to discharge rollers 16 by using conveyance rollers 8, and to discharge the printed paper sheet onto stacker 4 provided at the upper part of cover 2*a* of printer 1. Hence, main control unit 40 terminates the ongoing printing process. In this way, the printing process using the priority color setting is executed by printer 1 of this embodiment.

As described above, in this embodiment, one of the plural priority colors is selected by the user and the printing process is executed only when the arrangement order of development units 11 matches the transfer order that is predetermined for the selected priority color. Accordingly, in this embodiment, the toner or toners selected for producing the priority color are transferred in the end. Thus, it is possible to perform vivid printing while improving reproducibility of the color that the user intends to prioritize. In addition, the toner for producing the selected priority color can be transferred as the topmost layer on the paper sheet. Thus, a vivid printed image with improved reproducibility of the selected priority color can be obtained.

Second Embodiment

Figure 11:
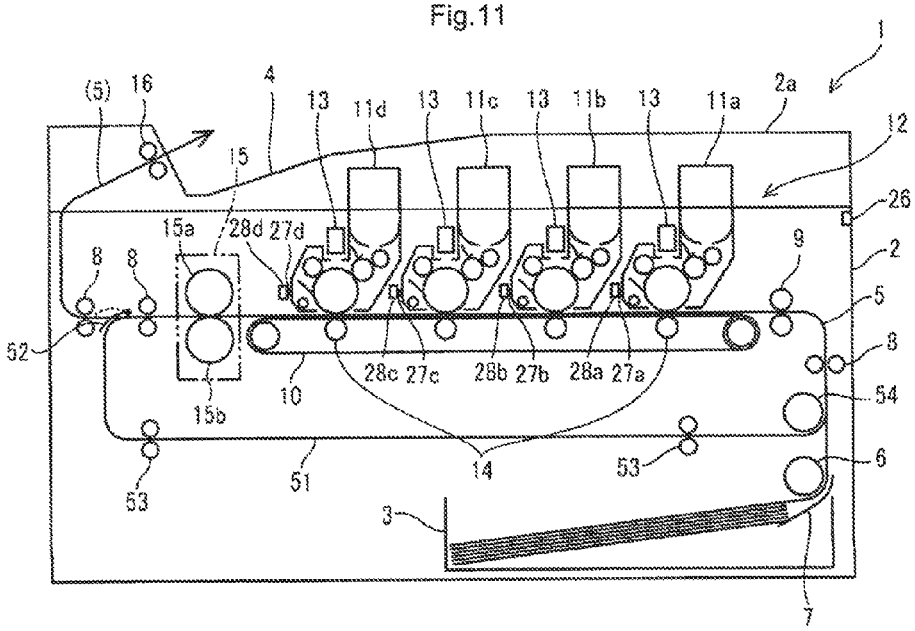
FIG. 11 is an explanatory view illustrating a printer of a second embodiment.

A printer of this embodiment is described below with reference to FIG. 11 to FIG. 15. Here, it is to be noted that constituents similar to those in the first embodiment are denoted by the same reference numerals and descriptions thereof are omitted. As illustrated in FIG. 11, printer 1 of this embodiment is provided with return conveyance passage 51, which branches off from a portion of paper conveyance passage 5 between two pairs of conveyance rollers 8 located downstream of fixation device 15 in the paper conveyance direction, passes through a space between conveyance belt 10 and paper feed cassette 3, and joins a portion of paper conveyance passage 5 between paper feed roller 6 and conveyance rollers 8 located downstream thereof.

Switch blade 52 is provided at a bifurcation portion between return conveyance passage 51 and paper conveyance passage 5, and serves as a conveyance direction switch, which is configured to switch the conveyance direction of the paper sheet conveyed from the fixation device 15 side to either a direction (illustrated with a broken line in FIG. 11, referred to as an ordinary conveyance position) of paper conveyance passage 5 (also referred to as a discharge conveyance passage) leading to discharge rollers 16, or a direction (illustrated with a solid line in FIG. 11, referred to as a return conveyance position) of return conveyance passage 51 by using a not-illustrated solenoid.

In addition, return conveyance rollers 53 are disposed on return conveyance passage 51 and are configured to sandwich and convey the paper sheet to be conveyed on return conveyance passage 51. Return paper feed roller 54 is provided at a junction with paper conveyance passage 5. Accordingly, in this embodiment, a paper sheet required to be subjected to return printing (which means printing toner images on the surface of the paper sheet using some of development units 11, and then transferring and fixing the other toner images to the same surface again using the other development units 11 after performing the return conveyance) is guided to return conveyance passage 51 by locating switch blade 52 at the position illustrated with the solid line. Hence, the paper sheet can be conveyed to return paper feed roller 54 by return conveyance rollers 53 back to paper conveyance passage 5, and then conveyed to conveyance belt 10 again by conveyance rollers 8 and registration rollers 9.

In this embodiment, four priority color settings are defined as in the first embodiment. The transfer orders are also the same. However, as illustrated in FIG. 12, for each of the priority color settings, the number of times of the return conveyance indicates how many times of return conveyance are required for performing toner image transfer in the transfer order of the newly set priority color setting, by using the development units 11 arranged in the arrangement order of the priority color setting (the preceding priority color setting) made in the immediately preceding printing process. Information associated with each of the priority color settings is stored in memory 47 in advance. This includes the number of times of the return conveyance, the transfer order determined for the priority color setting, the image formation conditions applicable to the priority color setting, and the like.

Printing by performing the return conveyance is likely to cause color drift or image shrinking. Accordingly, in this embodiment, the allowable number of times of return conveyance is limited to once or less. This allowable number of times of return conveyance is stored in memory 47. For this reason, when the newly set priority color setting is different from the preceding priority color setting, the feasibility of printing by retaining the arrangement order of development units 11 of the preceding priority color setting is limited only to combinations of the standard setting and the red-prioritized setting as indicated with thick frames in FIG. 12. Accordingly, in addition to the functions described in the first embodiment, arrangement determination part 44 of this embodiment has a function: to compare the number of times of the return conveyance stored corresponding to the priority color setting in memory 47 with the allowable number of times of return conveyance (which is once in this embodiment) stored in memory 47 when the current arrangement order of development units 11 is different from the transfer order of the priority color setting. Thus, the function is to determine whether or not it is feasible to perform printing by using the current arrangement order of development units 11.

Figure 13:
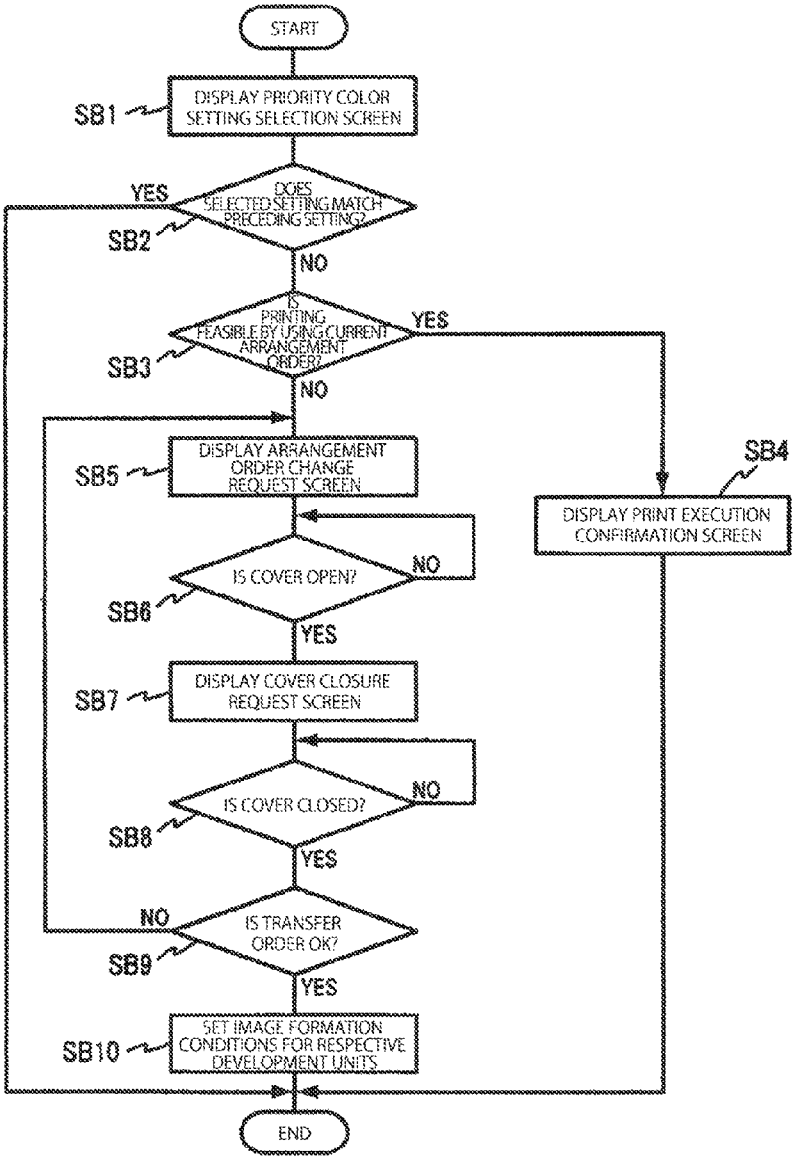
FIG. 13 is a flowchart illustrating a priority color setting process of the second embodiment.

A priority color setting process of this embodiment is described below in accordance with steps indicated by SB in the flowchart illustrated in FIG. 13. As in the first embodiment, the user who conducts printing by using printer 1 of this embodiment performs the priority color setting with printer 1 before transmission of the print data from host system 36. In the meantime, the preceding priority color setting, as well as the transfer order and the image formation conditions in the priority color setting, are saved in memory 47 of printer 1.

SB1: Main control unit 40 of printer 1 is standing by while displaying the priority color setting selection screen (see FIG. 9A), which displays the four priority color settings, selectable by the user, on display screen 35*a* of operation panel 35. When one of the priority color settings is selected, main control unit 40 recognizes the selected priority color setting and proceeds to step SB2. Main control unit 40 continues to stand by if none of the priority color settings is selected. In this case, the operation to select the priority color setting by the user is the same as that in the first embodiment, and the description is therefore omitted. The following descriptions are provided as an example for the case where the preceding priority color setting is the standard setting and the user newly selects the red-prioritized setting.

SB2: Upon recognition of the selected priority color setting, main control unit 40 reads the preceding priority color setting saved in memory 47. When the read preceding priority color setting does not match the newly selected priority color setting, main control unit 40 temporarily saves the read preceding priority color setting in memory 47 and displays the priority color setting confirmation screen (see FIG. 9C) on display screen 35*a* of operation panel 35. Main control unit 40 proceeds to step SB3 when the user selects "Yes." Main control unit 40 terminates the ongoing priority color setting process when the read preceding priority color setting matches the new priority color setting or when the user selects "No" on the priority color setting confirmation screen.

SB3: When recognizing that the user changes the priority color setting to the new priority color setting which does not match the preceding priority color setting, main control unit 40 reads the transfer order for the selected priority color setting (which is the red-prioritized setting in this description) from memory 47, as well as the number of times of return conveyance (see FIG. 12) and the image formation conditions for the preceding priority color setting (which is the standard setting in this description) which are temporarily saved in memory 47. Main control unit 40 causes arrangement determination part 44 to compare the read number of times of return conveyance with the allowable number of times of return conveyance (which is once in this embodiment) stored in memory 47. When the number of times of the return conveyance is equal to or below the allowable number of times of return conveyance, main control unit 40 determines that the printing is feasible by using the current arrangement order of development units 11, and then proceeds to step SB4. When the number of times of return conveyance exceeds the allowable number of times of return conveyance, main control unit 40 determines that the printing is not feasible by using the current arrangement order of development units 11, and then proceeds to step SB5.

Figure 14:
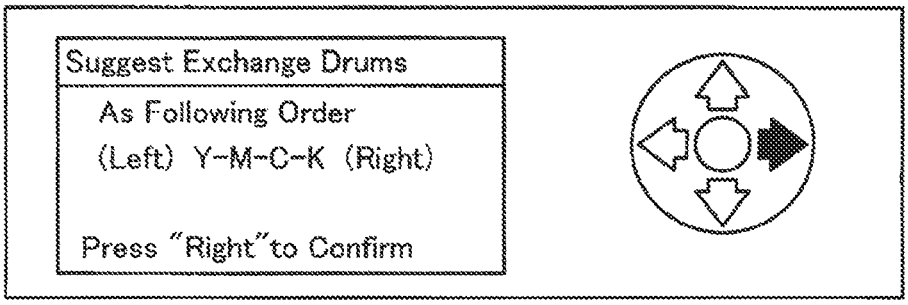
FIG. 14 is an explanatory view illustrating screen display examples in the priority color setting process of the second embodiment.

SB4: When determining that the printing is feasible by using the current arrangement order of development unit 11, main control unit 40 displays a print execution confirmation screen, as illustrated in FIG. 14, on display screen 35*a* of operation panel 35 by using display operation part 45. When the user presses the right button among cursor buttons 35*b*, main control unit 40 stops displaying the print execution confirmation screen and terminates the ongoing priority color setting process.

SB5: When determining that the printing is not feasible by using the current arrangement order of development unit 11, main control unit 40 displays the arrangement order change request screen (see FIG. 9D) on display screen 35*a* of operation panel 35 by using display operation part 45 as in step S3 of the first embodiment. Thus, main control unit 40 informs the user of the arrangement order of development units 11 reflecting the prompted change. Subsequent processing operations SB6 to SB10 are the same as the processing operations S4 to S8 of the first embodiment and the descriptions thereof are omitted. Thus, the priority color setting process of this embodiment is executed.

Figure 15:
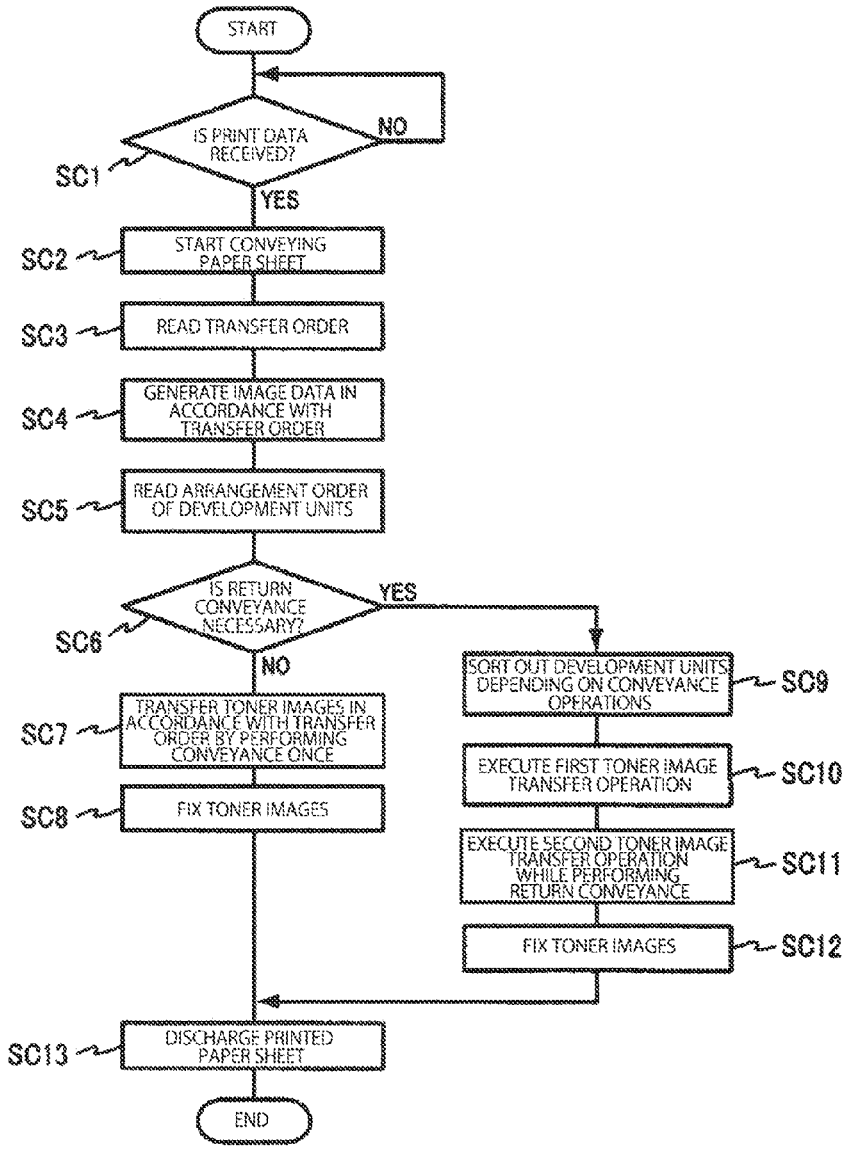
FIG. 15 is a flowchart illustrating a printing process of the second embodiment.

Now, descriptions are hereinbelow provided for processing operations of the printing process by printer 1, to be carried out when the user having completed the priority color setting transmits the print data from host system 36 to printer 1 and conducts printing by using the priority color setting of this embodiment, in accordance with the steps indicated with SC by using the flowchart illustrated in FIG. 15. Note that processing operations in steps SC1 to SC9 of this embodiment are the same as the processing operations SA1 to SA9 of the first embodiment and the descriptions thereof are omitted.

SC5: After generating the image data, main control unit 40 causes arrangement determination part 44 to read the color information (the toner identification information) stored in management tags 27*a* to 27*d* of development units 11*a* to 11*d* loaded into the respective loading parts by using identification information readers 28*a* to 28*d*. Then, main control unit 40 proceeds to step SC6.

SC6: After reading the current arrangement order of development units 11, main control unit 40 compares the read arrangement order of development units 11 with the transfer order of the priority color setting read from memory 47 in step S3. When the current arrangement order of development units 11 matches the read transfer order, main control unit 40 determines that the transfer is to be executed in the transfer order of the priority color setting by performing the conveyance once as usual, and then proceeds to step SC7. When the current arrangement order of development units 11 does not match the read transfer order, main control unit 40 determines that the transfer operation needs to involve the return conveyance, and then proceeds to step SC9.

SC7: When determining that the transfer is to be executed in the transfer order of the priority color setting by performing the conveyance once, main control unit 40 transfers the toner images to the paper sheet in the transfer order of the priority color setting on the basis of the transfer order and the image formation conditions thus read as in step SA5 of the first embodiment.

SC8: After transferring the toner images in the four colors to the surface of the paper sheet, main control unit 40 causes engine control part 43 to fix the toner images in the four colors to the surface of the paper sheet as in step SA6 of the first embodiment. Then, main control unit 40 proceeds to step S13.

SC9: On the other hand, when determining that the transfer operation needs to involve the return conveyance, main control unit 40 recognizes the color of the toner to be transferred in the first place based on the transfer order of the priority color setting. Main control unit 40 specifies the position of the arrangement of development unit 11 of the recognized color on the basis of the current arrangement order of development units 11 and the order of the colors read in step SC5. Then, main control unit 40 determines whether or not the color to be subsequently transferred (as the second color at this stage) in the transfer order of the priority color setting is included in the colors for development units 11 arranged on the downstream side of development unit 11 of the first color in the paper conveyance direction. When the color to be transferred is not included, main control unit 40 divides development units 11 into such groups as to execute the first transfer operation of the toner image with specified development unit 11. and to execute the second transfer operation of the toner images with other development units 11 in the arrangement order after the return conveyance.

When the color to be subsequently transferred is included on the downstream side of specified development unit 11, main control unit 40 divides development units 11 into such groups as to execute the first transfer operation of the toner images with specified development unit 11 and development unit 11 of the included color in the arrangement order; and then to execute the second transfer operation of the toner images with other development units 11 in the arrangement order after the return conveyance. In this embodiment, in step SB3 during the priority color setting, the return conveyance needs to be carried out only once. Accordingly, development units 11 can be grouped as described above.

In this description, the current arrangement order of development units 11 is equivalent to the arrangement order (C-M-Y-K) of the standard setting and the transfer order of the priority color setting is equivalent to the transfer order (K-C-M-Y) of the red-prioritized setting. Accordingly, main control unit 40 divides development units 11 in such groups as to execute the transfer by using development unit 11*d* for the color K in the first conveyance operation; and to execute the second transfer in the return conveyance and in the arrangement order (C-M-Y) of development units 11*a*, 11*b*, and 11*c*.

SC10: After grouping development units 11 for the transfer, main control unit 40 transfers the toner image to the surface of the paper sheet conveyed by conveyance belt 10 while using development unit 11 and the corresponding transfer roller 14 grouped in the first operation on the basis of development unit 11 and the image formation conditions of development unit 11 grouped in the first operation. Details of the transfer operation in this case are the same as the details of the operation described in step SA1 of the first embodiment. However, light irradiation using exposure head 13 and formation of the toner image on photoconductor drum 17 take place only in development unit 11 grouped in the first operation.

SC11: After transferring the toner image to the surface of the paper sheet using development unit 11 grouped in the first operation, main control unit 40 causes engine control part 43 to pass the paper sheet through fixation device 15 while omitting the transfer to the paper sheet using fixation device 15, to move switch blade 52 to the return conveyance position, to guide the paper sheet to the direction of return conveyance passage 51, to convey the paper sheet to the return paper feed roller 54 through return conveyance passage 51 and back to paper conveyance passage 5, to convey the paper sheet again to conveyance belt 10 using conveyance rollers 8 and registration roller 9, and to transfer the toner images to the surface of the paper sheet conveyed by conveyance belt 10 while using development units 11 and the corresponding transfer rollers 14 grouped in the second operation on the basis of development units 11 and the image formation conditions of development units 11 grouped in the second operation. Details of the transfer operation in this case are the same as those in step SC10.

SC12: After transferring the toner images in the four colors to the surface of the paper sheet as a consequence of the first and second transfer operations, main control unit 40 fixes the toner images in the four colors to the surface of the paper sheet as in step SA6 of the first embodiment.

SC13: Upon completion of the fixation of the toner images to the paper sheet, main control unit 40 causes engine control part 43 to guide the printed paper sheet with the fixed toner images in the direction of the discharge conveyance passage by moving switch blade 52 to the ordinary conveyance position, and to discharge the paper sheet onto stacker 4 provided at the upper part of cover 2*a* of printer 1 by using discharge rollers 16. Hence, the ongoing printing process is terminated. Thus, the printing process by printer 1 using the priority color setting of this embodiment is executed.

As described above, this embodiment has the following effects in addition to the same effects as those of the first embodiment. Specifically, even when the arrangement order of actually loaded development units 11 is different from the arrangement order of development units 11 for the priority color setting selected by the user, this embodiment can perform printing in accordance with the priority color setting selected by the user without changing the arrangement order of development units 11, but by subjecting the paper sheet to the return conveyance instead. As a consequence, this embodiment can perform vivid printing while improving the reproducibility of the priority color in the priority color setting selected by users. In addition, since the number of times of return conveyance in repeated printing is limited to only once, it is possible to reduce color drift or image shrinking in the course of printing on the paper sheet.

Third Embodiment

While the above-described embodiments explain the image formation apparatuses adopting the tandem method, the invention is also applicable to an image formation apparatus adopting a cycle method.

Figure 16:
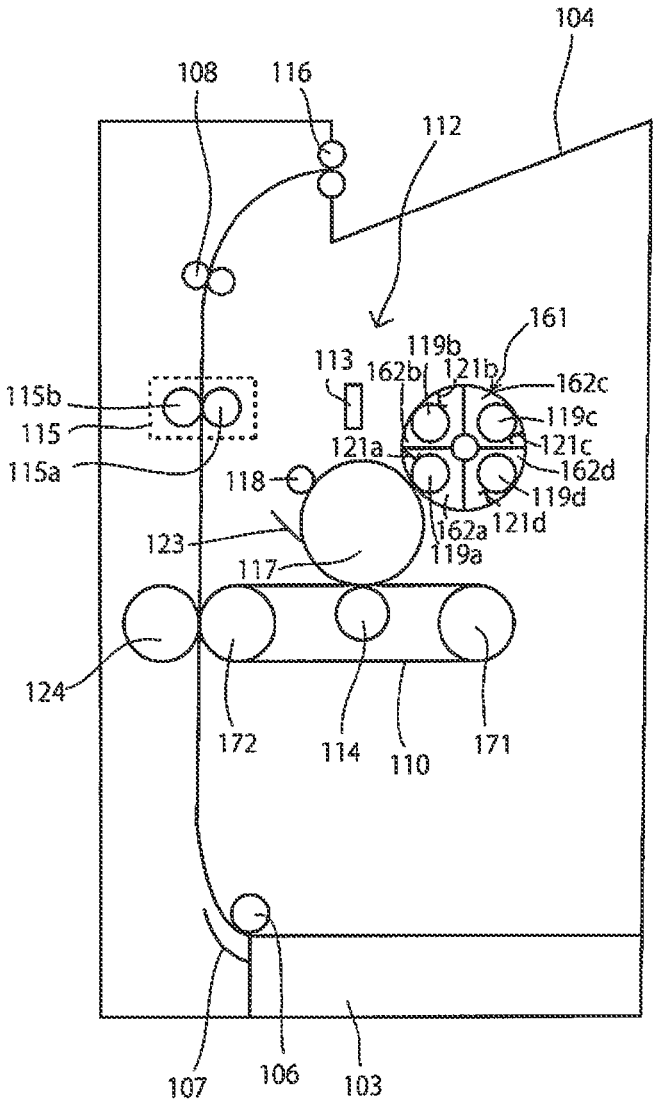
FIG. 16 is an explanatory view illustrating a printer of a third embodiment.

Now, an example of a printer as a four-cycle image formation apparatus is described in a third embodiment with reference to FIG. 16. A printer of the third embodiment is a four-cycle electrophotographic color printer configured to develop toner images in four colors separately on a surface of single photoconductor drum 117 by using developer suppliers 162*a*, 162*b*, 162*c*, and 162*d* for the four colors.

Paper feed cassette 103 is provided in a lower part of apparatus body 102, and stacker 104 is provided on an upper part of apparatus body 102. Paper conveyance passage 105 connecting paper feed cassette 103 to stacker 104 is formed inside apparatus body 102. Paper feed roller 106 and separator 107 are provided at a junction between paper feed cassette 103 and paper conveyance passage 105. Paper feed roller 106 and separator 107 feed paper sheets one by one from paper feed cassette 103 to paper conveyance passage 105. Not-illustrated registration rollers configured to convey each paper sheet while correcting a skew are provided on a downstream side of paper feed roller 106 in a paper conveyance direction. Transfer roller 124 is provided on a downstream side of the registration rollers in the paper conveyance direction. Intermediate transfer belt 110 is provided opposite transfer roller 129 across paper conveyance passage 105. Each paper sheet passes through a contact portion between intermediate transfer belt 110 and transfer roller 124 along paper conveyance passage 105. When the paper sheet passes through the contact portion, a multi-color toner image on intermediate transfer belt 110 formed by developer image formation section 112 is transferred to the paper sheet by an electrostatic force generated by transfer roller 124.

Fixation device 115 is configured to fix the transferred toner multi-color image to the paper sheet and is provided on a downstream side of the contact portion between transfer roller 124 and intermediate transfer belt 110 in the paper conveyance direction. Fixation device 115 includes: heat roller 115*a* having a heat source and a backup roller 115*b* that is rotatable while in pressure contact with heat roller 115*a*. Using these rollers, the multi-color toner image on the paper sheet is pressed, heated, and thereby fixed to the paper sheet when the paper sheet passes through a space between heat roller 115*a* and backup roller 115*b*. In other words, the image is printed on the paper sheet. Paired conveyance rollers 108 and paired discharge rollers 116 for conveying the paper sheet discharged from fixation device 115 are disposed on a downstream side of fixation device 115 in the paper conveyance direction. The printed paper sheet is discharged onto stacker 104 by using paired conveyance rollers 108 and paired discharge rollers 116.

Next, the structure of developer image formation section 112 is described. Developer image formation section 112 is a developer image formation section adopting the four-cycle method. Developer image formation section 112 includes: photoconductor drum 161; charge roller 118 configured to charge photoconductor drum 117; exposure head 113 configured to expose a surface of photoconductor drum 117 to light and thereby to form electrostatic latent images; developer supply unit 161 capable of supplying the toners in the four colors to photoconductor drum 117; and cleaning blade 123 configured to remove the toners remaining on photoconductor drum 117. Intermediate transfer roller 114, serving as a transfer device, is disposed opposite photoconductor drum 117 of developer image formation section 112. Intermediate transfer belt 110, such as an endless belt to be rotated and conveyed by rollers 171 and 172, passes through the nip between photoconductor drum 117 and intermediate transfer roller 114. Intermediate transfer belt 110 is arranged to pass through a nip between transfer roller 124 and roller 172.

Developer supply unit 161 includes developer suppliers 162*a*, 162*b*, 162*c*, and 162*d* for the four colors which are arranged at given intervals (intervals at 90°). It is possible to control rotation of developer supply unit 161 intermittently by 90°, each while using spindle 153 as a rotation center. Developer suppliers 162*a*, 162*b*, 162*c*, and 162*d* include development rollers 119*a*, 119*b*, 119*c*, and 119*d*, and development blades 121*a*, 121*b*, 121*c*, and 121*d*, respectively.

A toner in each color is supplied from each of developer suppliers 162*a*, 162*b*, 162*c*, and 162*d* to photoconductor drum 117 and the toner image in that color is formed on photoconductor drum 117. Every time one of developer suppliers 162*a*, 162*b*, 162*c*, and 162*d* comes into contact with the surface of photoconductor drum 117, the surface of photoconductor drum 117 is charged by charge roller 118. The charged surface of photoconductor drum 117 is exposed to the light by exposure head 113 whereby the electrostatic latent image is formed on the surface of photoconductor drum 117. Thereafter, the toner in the one of developer suppliers 162*a*, 162*b*, 162*c*, and 162*d* that is in contact with the surface of photoconductor drum 117 adheres to the electrostatic latent image on the surface of photoconductor drum 117, and thereby the toner image is formed on the surface of photoconductor drum 117. The toner image on photoconductor drum 117 is transferred to intermediate transfer belt 110 by the electrostatic force generated by intermediate transfer roller 114. After the transfer, the toner remaining on photoconductor drum 117 is removed by cleaning blade 123. This cycle is repeated four times for the four colors.

When the toner images in the four colors are subsequently transferred to intermediate transfer belt 110, the toner images in the four colors are superimposed on each other on intermediate transfer belt 110 so as to be the multi-color toner image. The multi-color toner image on intermediate transfer belt 110 is conveyed as intermediate transfer belt 110 rotates. When the multi-color toner image on intermediate transfer belt 110 reaches the nip between transfer roller 124 and roller 172, the multi-color toner image is transferred onto the paper sheet being conveyed along paper conveyance passage 105 by the electrostatic force generated by transfer roller 124.

In the four-cycle printer of this embodiment, main control unit 40 reads the transfer order (an image formation order) and the image formation conditions of the priority color setting saved in memory 47 in response to the priority color selected by the user. Then, main control unit 40 determines the order of contact of developer suppliers 162*a*, 162*b*, 162*c*, and 162*d* with photoconductor drum 117, and individually forms the toner images in the four colors sequentially on photoconductor drum 117. The toner images in the four colors individually formed on photoconductor drum 117 are transferred onto intermediate transfer belt 110 in a superimposed manner so as to be a multi-color toner image on transfer belt 110. Eventually, when the multi-color toner image passes through the nip between transfer roller 124 and roller 172, the multi-color toner image on transfer belt 110 is transferred to the paper sheet that is being conveyed along along paper conveyance passage 105.

The above-described four-cycle printer can also achieve effects similar to those of the second embodiment.

It is also possible to perform the control as described in the first embodiment while using the structure of the third embodiment.

Although the embodiments describe the case where the four colors of black, red, blue, and green are defined as the priority colors, it is also possible to define three original colors of yellow, cyan, and magenta as the priority colors. Meanwhile, the embodiments describe the example of the printers using the four original colors. However, it is also possible to achieve effects similar to those of the embodiments by applying the invention to a multi-color printer that employs additional toners in original colors such as white and halftone colors.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus comprising:

a developer image formation section configured to form plural developer images whose colors are different from each other, the developer image formation section including a plurality of developer image formation units being individually attachable to and detachable from a body of the image formation apparatus and configured to form the respective color developer images;

a transfer device configured to transfer the plural developer images onto a medium while superimposing the developer images on each other, thereby to form a multi-color developer image on the medium; and a memory configured to store information on priority color settings including plural priority colors and transfer orders of the plural developer images which are predetermined for the respective priority colors, wherein the image formation apparatus is configured, when one of the priority colors is selected, to transfer the plural developer images sequentially in the transfer order for the priority color setting of the selected priority color, wherein, when the arrangement order of the plurality of developer image formation units does not match the transfer order for the priority color setting of the selected priority color, the image formation apparatus is configured to convey the medium through the transfer device multiple times to form the multi-color developer image in accordance with the transfer order for the priority color setting of the selected priority color, wherein the image formation apparatus is configured to limit the number of times that the medium is conveyed through the transfer device to be not more than two.

2. The image formation apparatus of claim 1, further comprising:

a display capable of displaying a list of the priority colors; and an operation part configured to allow a user to select one of the priority colors.

3. The image formation apparatus of claim 2, further comprising:

a control unit configured to, when one of the priority colors is selected, read the transfer order for the selected priority color from the memory.

4. The image formation apparatus of claim 3, wherein when an arrangement order of the developer image formation units does not match the read transfer order, the control unit is configured to prompt the user, through a notification part, to change the arrangement order of the developer image formation units so as to match the transfer order.

5. The image formation apparatus of claim 4, wherein the control unit is configured to prevent a start of an operation of the developer image formation section, a medium conveyance part, and the transfer device until the control unit determines that the arrangement order of the developer image formation units matches the read transfer order.

6. The image formation apparatus of claim 2, further comprising:

a control unit configured, when one of the priority colors is selected, to read the transfer order for the selected priority color from the memory, and to control a formation order of the plural developer images to be formed by the developer image formation section such that the plural developer images are transferred onto the medium in the read transfer order.

7. The image formation apparatus of claim 1, wherein the transfer order of the plural developer images for each of the priority colors stored in the memory is set such that one of the developers used to produce the priority color is transferred lastly.

8. The image formation apparatus of claim 7, wherein the one of the developers to produce the priority color is transferred as a topmost layer on a printing medium.

9. The image formation apparatus of claim 1, wherein the priority color settings stored in the memory include a black-prioritized setting, a red-prioritized setting, a blue-prioritized setting, and a green-prioritized setting.

10. The image formation apparatus of claim 1, wherein the developer image formation section is a tandem type in which the plurality of developer image formation units are configured to form single color toner images, respectively.

11. The image formation apparatus of claim 10, wherein each of the single color developer image formation units includes a developer container containing therein developer of a corresponding single color; an image carrier on which an electrostatic latent image can be formed; and a developer supply device configured to supply the developer from the developer container to the image carrier thereby forming a developer image of the single color on the image carrier.

12. The image formation apparatus of claim 10, wherein the medium is a printing medium.

13. The image formation apparatus of claim 1, wherein the developer image formation section is a cycle type in which the developer image formation section includes an image carrier; and a developer supply unit capable of supplying the plural developers whose colors are different from each other to electrostatic latent images formed on the image carrier.

14. The image formation apparatus of claim 13, wherein the transfer device is an intermediate transfer roller disposed opposite the image carrier and configured to generate electrostatic force, and the image formation apparatus further comprises an intermediate transfer belt as an endless belt configured to travel between the image carrier and the intermediate transfer roller.

15. The image formation apparatus of claim 14, wherein the medium is the intermediate transfer belt, wherein the developer images formed on the image carrier are transferred to the intermediate transfer belt by the electrostatic force generated by the intermediate transfer roller.

16. The image formation apparatus of claim 1, wherein the image formation apparatus is configured, when determining that the number of times that the medium is required to be conveyed through the transfer device is more than two, to output a notification.

17. The image formation apparatus of claim 1, wherein the transfer device is configured to transfer at least one of the developer images from the developer image formation units of the developer image formation section each time the medium is conveyed through the transfer device.

18. The image formation apparatus of claim 1, wherein, when the image formation apparatus determines that the number of times that the medium is required to be conveyed through the transfer device is more than two, the developer image formation section is prevented from a start of an operation to form the plural developer images.

* * * * *